US008577262B2

(12) United States Patent
Ohmori et al.

(10) Patent No.: US 8,577,262 B2
(45) Date of Patent: Nov. 5, 2013

(54) CHARGING DEVICE, CARTRIDGE FOR IMAGE FORMING APPARATUS, AND IMAGE FORMING APPARATUS

(75) Inventors: Masao Ohmori, Kanagawa (JP); Hidehiko Yamaguchi, Kanagawa (JP); Takanori Morino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 324 days.

(21) Appl. No.: 13/018,933

(22) Filed: Feb. 1, 2011

(65) Prior Publication Data

US 2011/0129257 A1 Jun. 2, 2011

(30) Foreign Application Priority Data

Sep. 24, 2009 (JP) ..... 2009-218863

(51) Int. Cl.
*G03G 15/02* (2006.01)

(52) U.S. Cl.
USPC ..... 399/168; 399/159; 399/267

(58) Field of Classification Search
USPC ..... 399/168, 267, 159, 299
See application file for complete search history.

(56) References Cited

U.S. PATENT DOCUMENTS

| | | | | |
|---|---|---|---|---|
| 5,642,254 | A * | 6/1997 | Benwood et al. | 361/235 |
| 2009/0074463 | A1 * | 3/2009 | Nishio et al. | 399/170 |
| 2009/0220279 | A1 * | 9/2009 | Adachi | 399/168 |

FOREIGN PATENT DOCUMENTS

| | | |
|---|---|---|
| JP | A-2000-187371 | 7/2000 |
| JP | A-2001-75336 | 3/2001 |

* cited by examiner

*Primary Examiner* — Walter L Lindsay, Jr.
*Assistant Examiner* — Roy Y Yi
(74) *Attorney, Agent, or Firm* — Oliff & Berridge, PLC

(57) ABSTRACT

A charging device includes:
a first electrode;
a second electrode;
an insulating body that is provided between the first electrode and the second electrode;
wherein either the first electrode or the second electrode includes an opening portion that is formed so as to open toward a first direction in which the first electrode, the insulating body, and the second electrode are laminated, and
the insulating body includes a region limiting portion which is a space that communicates with the opening portion, and opens toward a direction in which the region limiting portion communicates with the opening portion, and is limited in a second direction vertical to the first direction.

15 Claims, 10 Drawing Sheets

VOLTAGE DIFFERENCE: RESISTIVE LAYER 74 (FIRST ELECTRODE) - CONDUCTIVE LAYER 78 (SECOND ELECTRODE)

CHARGING DEVICE, CARTRIDGE FOR IMAGE FORMING APPARATUS, AND IMAGE FORMING APPARATUS

CROSS-REFERENCE TO RELATED APPLICATIONS

This application is based on Japanese Patent Application No. 2009-218863 filed on Sep. 24, 2009.

BACKGROUND

The present invention relates to a charging device, a cartridge for an image forming apparatus, and an image forming apparatus.

SUMMARY

According to an aspect of the invention, there is provided a charging device including: a first electrode; a second electrode; an insulating body that is provided between the first electrode and the second electrode; wherein either the first electrode or the second electrode includes an opening portion that is formed so as to open toward a first direction in which the first electrode, the insulating body, and the second electrode are laminated, and the insulating body includes a region limiting portion which is a space that communicates with the opening portion, and opens toward a direction in which the region limiting portion communicates with the opening portion, and is limited in a second direction vertical to the first direction.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described with reference to the accompanying drawings.

Figure 1:
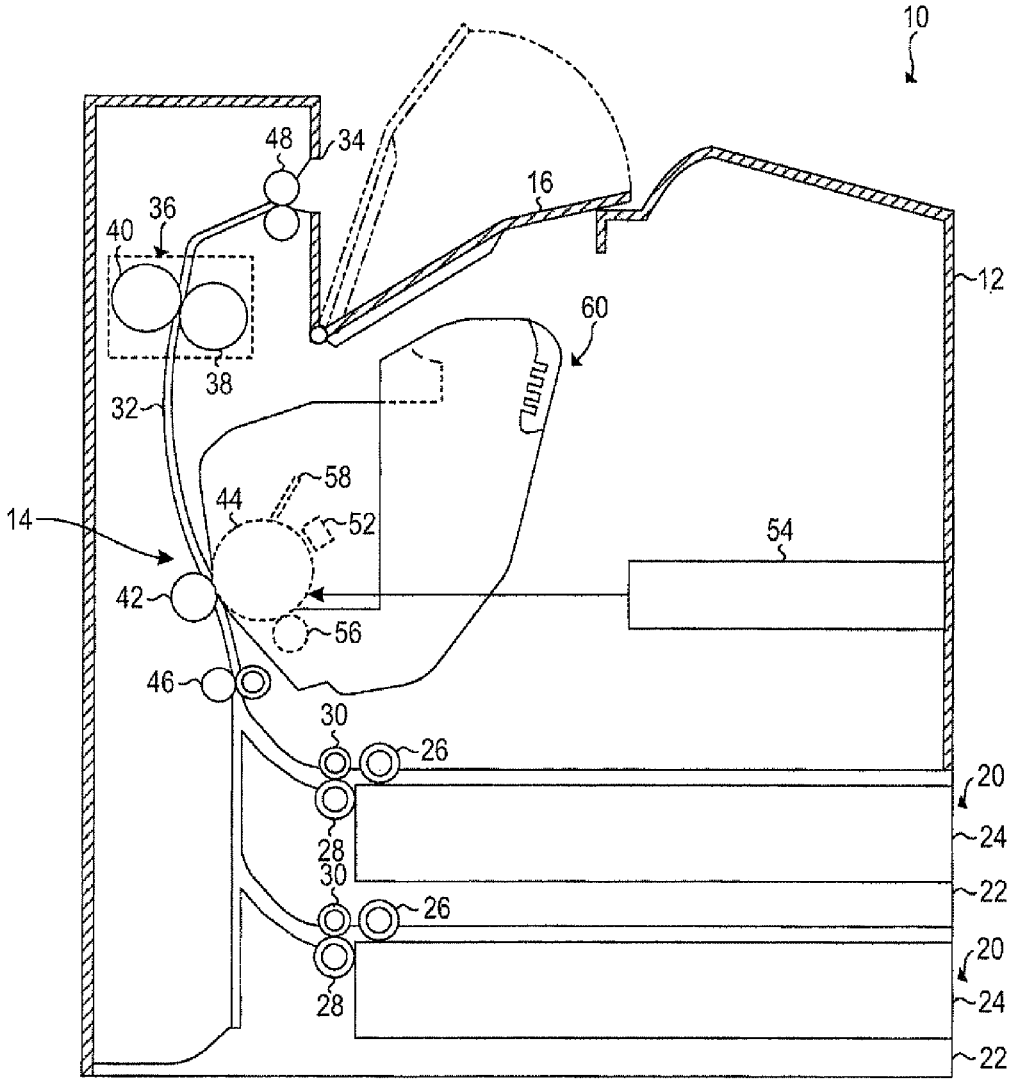
FIG. 1 is a side view illustrating an image forming apparatus according to an exemplary embodiment of the invention.

FIG. 1 shows the overall structure of an image forming apparatus 10 according to an exemplary embodiment of the invention. The image forming apparatus 10 includes an image forming apparatus body 12. The image forming apparatus body 12 includes an image forming unit 14 and a discharge unit 16 is provided at an upper part of the image forming apparatus body 12.

For example, two-stage sheet feeding devices 20 are provided at a lower part of the image forming apparatus body 12. In addition, plural sheet feeding devices may be additionally provided at a lower part of the image forming apparatus body 12.

Each of the sheet feeding devices 20 includes a sheet feeding device body 22 and a sheet feeding cassette 24 having recording media stored therein. A pick-up roller 26 is provided at an upper part of the rear end of the sheet feeding cassette 24, and a retard roller 28 is provided on the rear side of the pick-up roller 26. In addition, a feed roller 30 is arranged so as to face the retard roller 28.

A transport path 32 is a recording medium path from the feed roller 30 to a discharge port 34. The transport path 32 is substantially vertically formed from the lowermost sheet feeding device 20 to a fixing unit 36 in the vicinity of the rear side (the left surface of FIG. 1) of the image forming apparatus body 12. A heating roller 38 and a pressure roller 40 are provided in the fixing unit 36. A transfer roller 42 and an image carrier 44 serving as a photoconductor are arranged on the upstream side of the fixing unit 36 in the transport path 32, and a registration roller 46 is arranged on the upstream side of the transfer roller 42 and the image carrier 44. In addition, a discharge roller 48 is arranged in the vicinity of the discharge port 34 in the transport path 32.

Therefore, a recording medium is transported from the sheet feeding cassette 24 of the sheet feeding device 20 by the pick-up roller 26. The uppermost recording medium is transported to the transport path 32 by the retard roller 28 and the feed roller 30 and then passes between the transfer roller 42 and the image carrier 44 at the time when the registration roller 46 is temporarily stopped. At that time, a toner image is transferred to the recording medium. The transferred toner image is fixed to the recording medium by the fixing unit 36 and the recording medium is discharged from the discharge port 34 to the discharge unit 16 by the discharge roller 48.

The image forming unit 14 is, for example, an electrophotographic type and includes the image carrier 44, a charging device 52 that uniformly charges the image carrier 44, a light writing device 54 that writes a latent image on the image carrier 44 charged by the charging device 52 using light, a developing device 56 that visualizes the latent image formed on the image carrier 44 by the light writing device 54 using a developer, the transfer roller 42 that transfers the toner image developed by the developing device 56 to the recording medium, a cleaning device 58 including, for example, a blade that cleans the developer remaining on the image carrier 44, and the fixing unit 36 that fixes the toner image transferred to the recording medium by the transfer roller 42 to the recording medium.

A process cartridge 60 is formed by integrating the image carrier 44, the charging device 52, the developing device 56, and the cleaning device 58, which can be integrally replaced. The discharge unit 16 can be opened to remove the process cartridge 60 from the image forming apparatus body 12.

Next, the charging device 52 will be described in detail.

Figure 2:
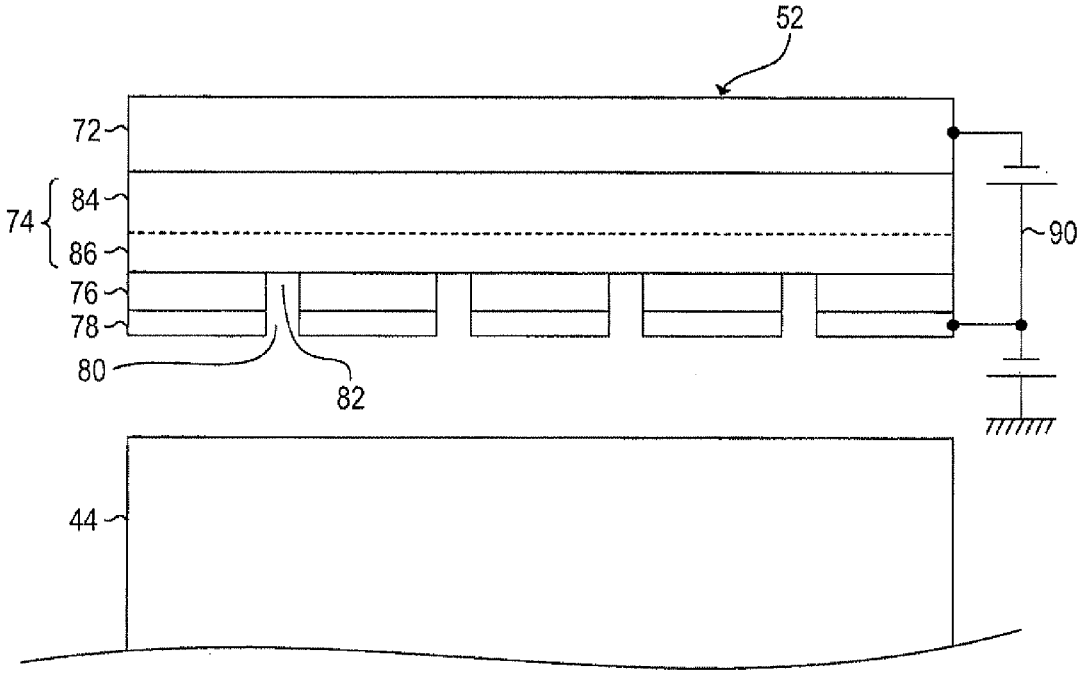
FIG. 2 is a diagram illustrating a charging device according to an exemplary embodiment of the invention and a peripheral structure thereof.
Figure 3:
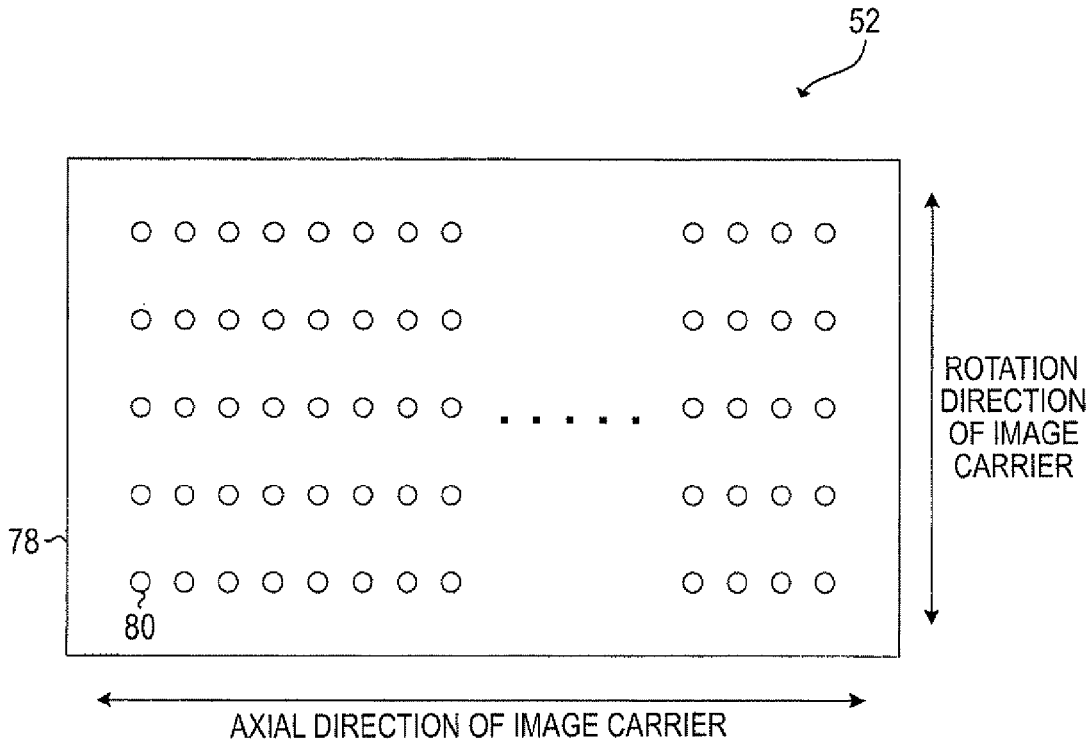
FIG. 3 is a diagram illustrating the lower surface of the charging device according to the exemplary embodiment of the invention.

FIG. 2 is a cross-sectional view illustrating the charging device 52 and a peripheral structure thereof, and FIG. 3 shows the lower surface (a surface facing the image carrier 44) of the charging device 52. The charging device 52 includes a conductive base 72, a resistive layer 74, an insulating layer 76, and a conductive layer 78 which are arranged in this order from a side that is away from the image carrier 44 opposite to the charging device 52.

Opening portions 80 are provided in the conductive layer 78, and region limiting portions 82, which are spaces communicating with the opening portions 80, are provided in the insulating layer 76. The region limiting portion 82 is opened toward the image carrier 44 and has, for example, a cylindrical shape.

The resistive layer 74 may be formed in a two-layer structure of a high-resistance layer 84 and a resistance adjusting layer 86.

A power supply 90 is connected to each of the conductive base 72 and the conductive layer 78. When a DC voltage of a predetermined level or more is applied between the conductive base 72 and the conductive layer 78, a discharge occurs in the region limiting portion 82 that is surrounded by the resistive layer 74, the insulating layer 76, and the conductive layer 78 and is spatially limited, using the resistive layer 74 and the conductive layer 78 as first and second electrodes, respectively.

The discharge occurring in the region limiting portion 82 of the charging device 52 (for example, detailed parameters will be described below) according to this exemplary embodiment is called a glow discharge. The glow discharge is a continuous and uniform discharge phenomenon generated at a low pressure that is about one-hundredth of the atmospheric pressure.

Since the region limiting portion 82 is opened toward the image carrier 44, some of the charged particles generated by the discharge are moved to the image carrier 44 through the conductive layer 78 (second electrode) by a potential difference between the conductive layer 78 (second electrode) and the image carrier 44. That is, some of the charged particles are drifted by the electric field. In this way, the image carrier 44 is charged.

The conductive layer 78 (second electrode) has a function of adjusting the intensity of the electric field for moving the charged particles to the image carrier 44 when a voltage is applied and adjusting a charging potential.

The conductive base 72 is made of, for example, a metal material, such as stainless steel, aluminum, a copper alloy, alloys thereof, or iron subjected to a surface treatment, such as chrome or nickel.

The resistive layer 74 is made of a material having a volume resistivity in the range of equal to or more than $1\times10^{6}$ Ωcm and equal to or less than $1\times10^{10}$ Ωcm.

When the volume resistivity of the resistive layer 74 is more than $1\times10^{10}$ Ωcm, a discharge between the electrodes is likely to be insufficient. As a result, a discharge sporadically occurs in the region limiting portion 82, which is a discharge space, and a stable glow discharge is unlikely to occur.

When the volume resistivity of the resistive layer 74 is less than $1\times10^{6}$ Ωcm, a function of limiting a discharge current using resistance (hereinafter, referred to as a discharge current limiting effect) is not sufficiently obtained and a discharge is locally concentrated on the plane of the resistive layer 74 facing the region limiting portion 82. As a result, the discharge current is unstable or excessively large, which may cause a rapid deterioration of the material or a short circuit of the resistive layer 74.

When the volume resistivity of the resistive layer 74 is in the range of equal to or more than $1\times10^{7}$ Ωcm and equal to or less than $1\times10^{9}$ Ωcm, a stable glow discharge is maintained by the region limiting portion 82, as compared to when the volume resistivity of the resistive layer 74 is beyond the range of equal to or more than $1\times10^{7}$ Ωcm and equal to or less than $1\times10^{9}$ Ωcm.

The resistive layer 74 is formed with a thickness equal to or more than 10 μm.

From the viewpoint of obtaining the discharge current limiting effect using the resistance of the resistive layer 74, a material that is capable of reducing the thickness of the resistive layer and has high resistivity may be selected to adjust the resistance value of the resistive layer 74 calculated by (volume resistivity×thickness of resistive layer/unit area). When the thickness is less than 10 μm, resistance to a voltage applied is reduced. As a result, during discharge, a short circuit frequently occurs in the resistive layer 74. When the thickness is in the range of equal to or more than 100 μm, a sufficient dielectric strength voltage is obtained and temporal stability with respect to a high voltage applied is ensured.

When the resistance value (a value calculated by volume resistivity×thickness of resistive layer/area (where the area is of a circle with a diameter of 100 μm)) of the resistive layer 74 in the thickness direction is adjusted to fall within the range of equal to or more than $1\times10^{8}$Ω and equal to or less than $1\times10^{11}$Ω while the resistive layer 74 satisfies the above-mentioned optimal volume resistivity range of equal to or more than $1\times10^{7}$ Ωcm and equal to or less than $1\times10^{9}$ Ωcm and the above-mentioned optimal thickness range of equal to or more than 100 μm, both the effect of limiting a discharge current using a resistive component and temporal stability by the ensured thickness are obtained.

The resistive layer 74 may have a two-layer structure to adjust the discharge limiting effect. For example, the upper layer (high-resistance layer 84) has a volume resistivity of $1\times10^{9}$ Ωcm and a thickness of 30 μm to obtain a sufficient discharge current limiting effect and the lower layer (resistance adjusting layer 86) has a volume resistivity of $1\times10^{7}$ Ωcm and a thickness of 100 μm. In this way, the effect of limiting a discharge using resistance is ensured by the upper layer (high-resistance layer 84), and the thickness from the conductive base 72 is sufficiently large to improve voltage resistance. Therefore, both the discharge current limiting effect and temporal stability are obtained.

A member obtained by dispersing conductive particles or semiconductive particles in a resin material or a rubber material is used as the resistive layer 74. Examples of the resin material include, a polyester resin, an acrylic resin, a melamine resin, an epoxy resin, a urethane resin, a silicon resin, a urea resin, a polyamide resin, a polyimide resin, a polycarbonate resin, a styrene resin, an ethylene resin, and a composite resin thereof. Examples of the rubber material include ethylene-propylene rubber, polybutadiene, natural rubber, polyisobutylene, chloroprene rubber, silicon rubber, urethane rubber, epichlorohydrin rubber, fluorosilicone rubber, ethylene oxide rubber, foam materials thereof, and a mixed base material thereof.

As the conductive particles or the semiconductive particles, the following materials may be used: metal materials, such as carbon black, zinc, aluminum, copper, iron, nickel, chrome, and titanium; metal oxides, such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, and MgO; an ionizable compound, such as quaternary ammonium salt; and mixtures of two or more kinds of materials selected from them.

The material forming the resistive layer 74 is not limited to an organic material, such as resin or rubber, and the resistive layer 74 may be made of semiconductive glass obtained by dispersing conductive particles in glass or a porous anodic aluminum oxide film.

The structure of the region limiting portion 82 limiting the discharge space is determined by the diameter of a hole passing through the insulating layer 76 and the conductive layer 78 (second electrode) and the thickness of the insulating layer 76.

The region limiting portion 82 that two-dimensionally limits a discharge in a direction parallel to the image carrier 44 is formed with a hole diameter equal to or more than 4 μm and equal to or less than 200 μm. The hole diameter is the length of the region limiting portion 82 in a direction vertical to the direction in which the conductive base 72, the resistive layer 74, the insulating layer 76, and the conductive layer 78 are laminated.

When the hole diameter is more than 200 μm, the intensity of the electric field of the edge of the opening portion 80 of the conductive layer 78 (second electrode) or a peripheral portion thereof is several times more than that of the electric field of a central portion of the opening portion, which is calculated by general static electric field analysis. When the distribution of the electric field in the region limiting portion 82 is not uniform, a discharge is concentrated on the peripheral portion of the opening portion. As a result, a discharge is unstable, which may cause an increase in the amount of ozone generated or a short circuit of the resistive layer 74.

When the hole diameter is equal to or less than 200 μm, an equipotential plane is formed so as to be approximately parallel to an insulating body and the distribution of the electric field in the region limiting portion 82 is uniform. As a result, a stable glow discharge is easily generated in the entire region limiting portion 82.

When the hole diameter is less than 4 μm, the amount of discharge generated in each region limiting portion 82 is reduced. Therefore, it is preferable to set the hole diameter to 4 μm or more, in order to effectively charge the image carrier 44 to a target potential.

When the hole diameter of the region limiting portion 82 is in the range of equal to or more than 50 μm and equal to or less than 150 μm, a uniform discharge is effectively generated in the entire region limiting portion 82, as compared to when the hole diameter is beyond the range of equal to or more than 50 μm and equal to or less than 150 μm.

The material forming the insulating layer 76 is not limited to an organic material and an inorganic material. When a solid-state material having a volume resistivity of $1\times10^{12}$ Ωcm or more is used, the insulation between both electrodes (the resistive layer 74 and the conductive layer 78) is improved when a high voltage is applied and the shape of the region limiting portion 82 is stably maintained without being changed over time, as compared to when a material having a volume resistivity of less than $1\times10^{12}$ Ωcm is used.

The insulating layer 76 is formed with a thickness equal to or more than 4 μm and equal to or less than 200 μm. In this embodiment, since the region limiting portion 82 is provided so as to pass through the insulating layer 76, the thickness of the insulating layer 76 limits the distance between two electrodes (the resistive layer 74 and the conductive layer 78), that is, a discharge distance. That is, the thickness of the insulating layer 76 is the length of the region limiting portion 82 in the direction in which the conductive base 72, the resistive layer 74, the insulating layer 76, and the conductive layer 78 are laminated.

When the thickness of the insulating layer 76 is set to 200 μm or less to reduce the discharge distance, the local concentration of discharge and a rapid increase in the discharge current are prevented, which makes it easy to maintain a glow discharge. When the thickness of the insulating layer 76 is set to 4 μm or more to obtain a discharge distance sufficiently larger than the mean free path (about 0.1 μm) of electrons in air, the number of ionizations in the region limiting portion 82 is ensured, which makes it easy to maintain a discharge.

According to Paschen's law defining a discharge starting voltage between parallel plates in air and at atmospheric pressure, when a gap is about 4 μm, the discharge starting voltage has a minimum value. When the gap is less than 4 μm, the discharge starting voltage increases. This shows that, when the thickness of the insulating layer 76 is less than 4 μm, it is difficult to generate a discharge.

If the thickness of the insulating layer 76 is in the range of equal to or more than 50 μm and equal to or less than 150 μm, the insulation between the electrodes with respect to a high voltage is improved, and a uniform discharge is stably maintained, as compared to when the thickness is beyond the range of equal to or more than 50 μm and equal to or less than 150 μm.

The conductive layer 78 (second electrode) is made of a material having a volume resistivity of $1\times10^{-1}$ Ωcm or less.

The conductive layer 78 (second electrode) is formed with a thickness equal to or more than 1 μm and equal to or less than 50 μm.

When the thickness is more than 50 μm, the extraction efficiency of charged particles from the opening portion 80 to the image carrier 44 is not sufficient.

When the thickness is less than 1 μm, the electrode is likely to be broken by a current during discharge.

The conductive layer 78 (second electrode) is made of a metal material that is less likely to be contaminated with a discharge gas. For example, the conductive layer 78 is made of a metal material, such as tungsten, molybdenum, carbon, platinum, copper, or aluminum, or a material obtained by performing a surface treatment, such as gold plating, on the metal material.

Basically, a DC voltage is applied between two electrodes (the resistive layer 74 (first electrode) and the conductive layer 78 (second electrode)). The target charging potential of the conductive layer 78 (second electrode) close to the image carrier 44 is substantially equal to that of the image carrier 44. A voltage that is about 1.0 kV to 1.5 kV higher than the voltage of the conductive layer 78 (second electrode) and generates a discharge between both electrodes is applied to the resistive layer 74 (first electrode).

The charging device 52 is arranged at a position where the distance between the conductive layer 78 (second electrode) arranged close to the image carrier 44 and the image carrier 44 where no discharge occurs is maintained, in order to charge the image carrier 44 using the movement (drift) of charged particles by the electric field.

The conductive layer 78 (second electrode) and the image carrier 44 are arranged such that the distance therebetween is in the range of equal to or more than 300 μm and equal to or less than 2 mm.

When the distance between the conductive layer 78 (second electrode) and the image carrier 44 is less than 300 μm, a discharge is likely to occur between the conductive layer 78 (second electrode) and the image carrier 44 and a load is generated in the image carrier 44. For example, in a case in which the target charging potential is −700 V, a voltage of −2 kV is applied to the resistive layer 74 (first electrode), and a voltage of −750 V is applied to the conductive layer 78 (second electrode), when the distance between the conductive layer 78 and the image carrier 44 is less than 300 μm, a discharge is likely to occur from the resistive layer 74 (first electrode) to the image carrier 44 through the conductive layer 78 (second electrode), from the estimation of the discharge starting voltage due to Paschen's law.

When the distance between the conductive layer 78 (second electrode) and the image carrier 44 is more than 2 mm, charging efficiency is reduced.

EXAMPLES

Figure 4:
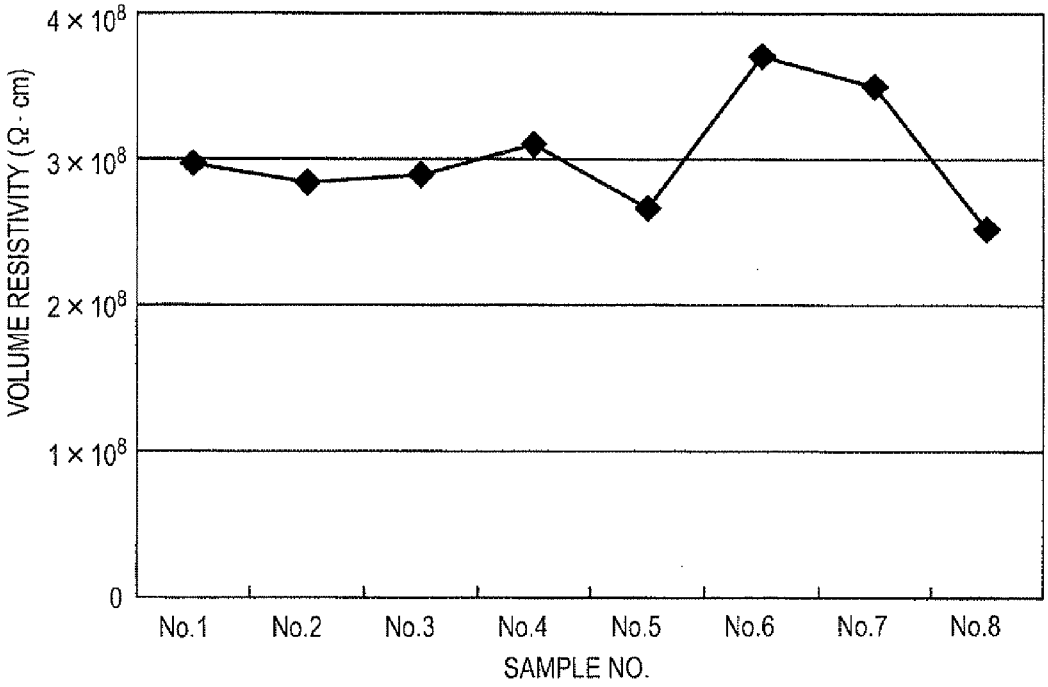
FIG. 4 is a diagram illustrating the measurement result of the volume resistivity of a resistive layer according to an example.

Hereinafter, examples will be described, but the invention is not limited thereto. The conductive base 72 is made of stainless steel (SUS) and the resistive layer 74 is made of a material which is obtained by dispersing carbon in a polyimide resin and has a volume resistivity of $3\times10^8$ Ωcm and a thickness of 150 μm. FIG. 4 shows the measurement result of the volume resistivity of the material forming the resistive layer 74 by a high resistivity meter Hiresta IP (MCP-HT260) and an HRS probe under the condition that a voltage of 250 V is applied for one minute. There is a maximum error of about 10%, but a volume resistivity of about $3\times10^8$ Ωcm is estimated. These materials are formed on the conductive base 72.

A glass epoxy material with a thickness of 100 μm is used as the insulating layer 76, and copper foil with a thickness of 18 μm is formed as the conductive layer 78 (second electrode) on the insulating layer 76 by gold-plating. The region limiting portions 82 having a cylindrical shape with a hole diameter of 100 μm are formed in the insulating layer 76 and the conductive layer 78 so as to pass through the insulating layer 76 and the conductive layer 78.

The insulating layer 76 and the conductive layer 78 are closely adhered and fixed to the resistive layer 74, thereby forming electrodes. The region limiting portions 82, which are discharge spaces, are arranged in a line at intervals of 400 μm in parallel to the axial direction of the image carrier 44 and have a width required for charging. In order to improve a charging performance, five rows of region limiting portions are arranged at intervals of 750 μm in the rotation direction of the image carrier 44 (see FIG. 3).

The distance between the image carrier 44 and the conductive layer 78 (second electrode) is set to 400 μm. The distance between the region limiting portions 82 in the axial direction of the image carrier 44 is at least equal to or less than the distance between the image carrier 44 and the conductive layer 78 (second electrode) such that a strip-shaped variation does not occur in potential due to the charged particles moved from the region limiting portion 82 onto the image carrier 44 by the electric field, but uniform potential is obtained. The number of rows in the rotation direction is adjusted depending on the process speed such that a necessary charging performance can be ensured.

Figure 5:
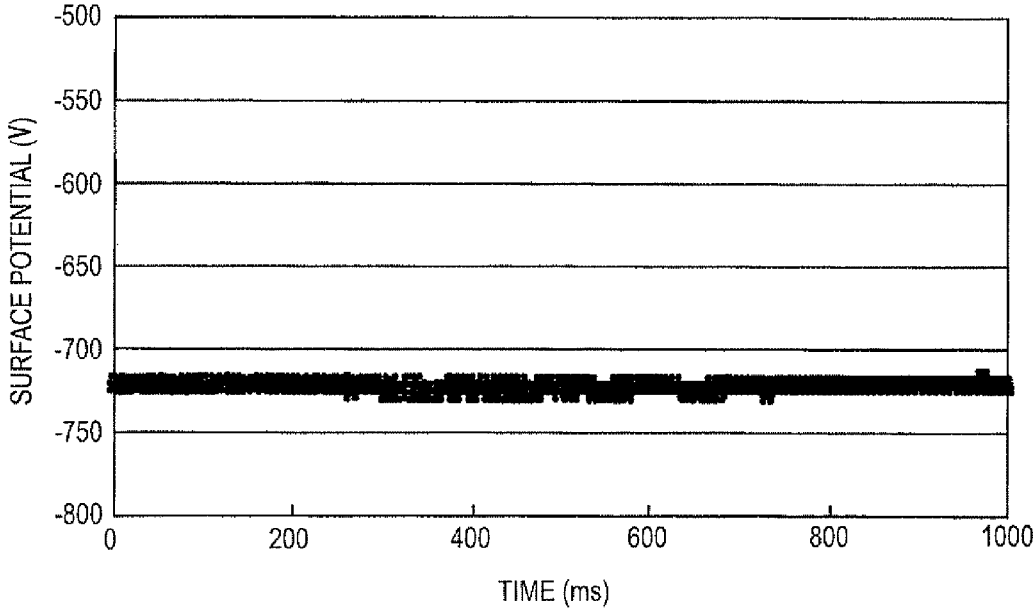
FIG. 5 is a diagram illustrating the measurement result of a charging potential according to an example.
Figure 6:
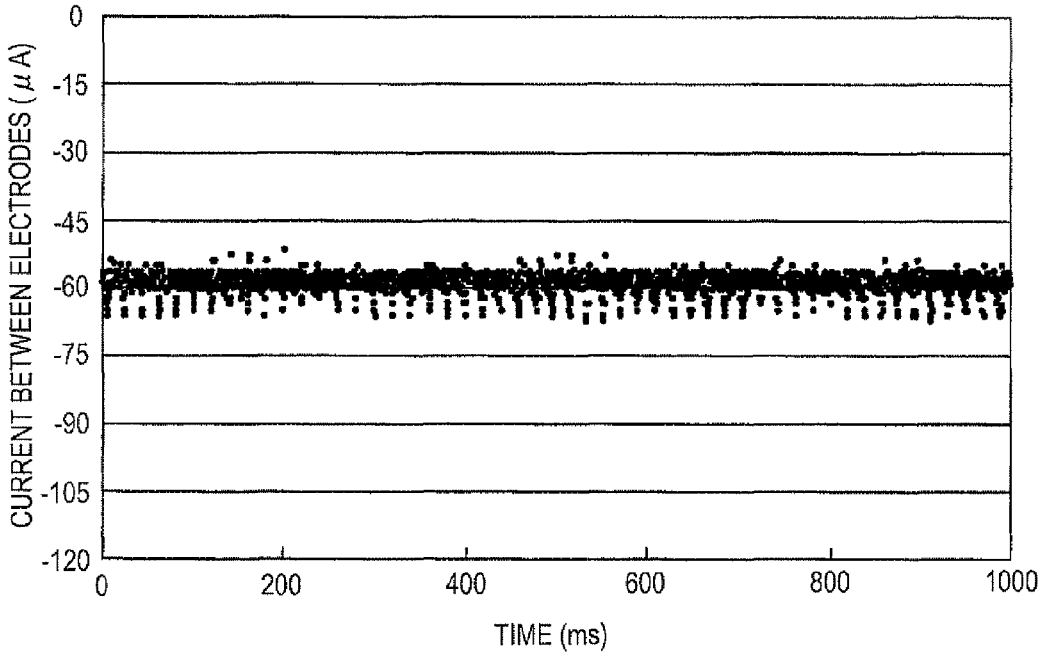
FIG. 6 is a diagram illustrating the measurement result of a discharge current according to an example.

In the example having the above-mentioned structure, when the target voltage is −720 V, a DC voltage of −2.2 kV is applied to the conductive base 72, and a DC voltage of −800 V is applied to the conductive layer 78 (second electrode) to rotate the image carrier 44 with a diameter of Φ30 mm at a process speed of 120 mm/sec, the charging potential (FIG. 5) of the image carrier 44 and a discharge current (FIG. 6) flowing between the conductive base 72 and the conductive layer 78 (second electrode) are shown as graphs.

The rotation period of the image carrier 44 is 780 ms, a variation in the charging potential is stabilized at about Δ10 V or less, and the image carrier 44 is charged to a target value (−720 V). The discharge current is about 60 μA per a charging width of 5 cm in the axial direction of the image carrier 44. Since the number of holes (region limiting portions 82) with a width of 5 cm is 630, the discharge current per region limiting portion 82 has a very small value of about 0.1 μA. In this case, a voltage difference between the conductive base 72 and the conductive layer 78 (second electrode) is reduced such that the discharge current is set as small as possible within the range capable of maintaining the charging performance. When the discharge current increases, the amount of ozone generated increases. Therefore, when the discharge current is reduced, the amount of ozone generated is reduced.

Figure 7:
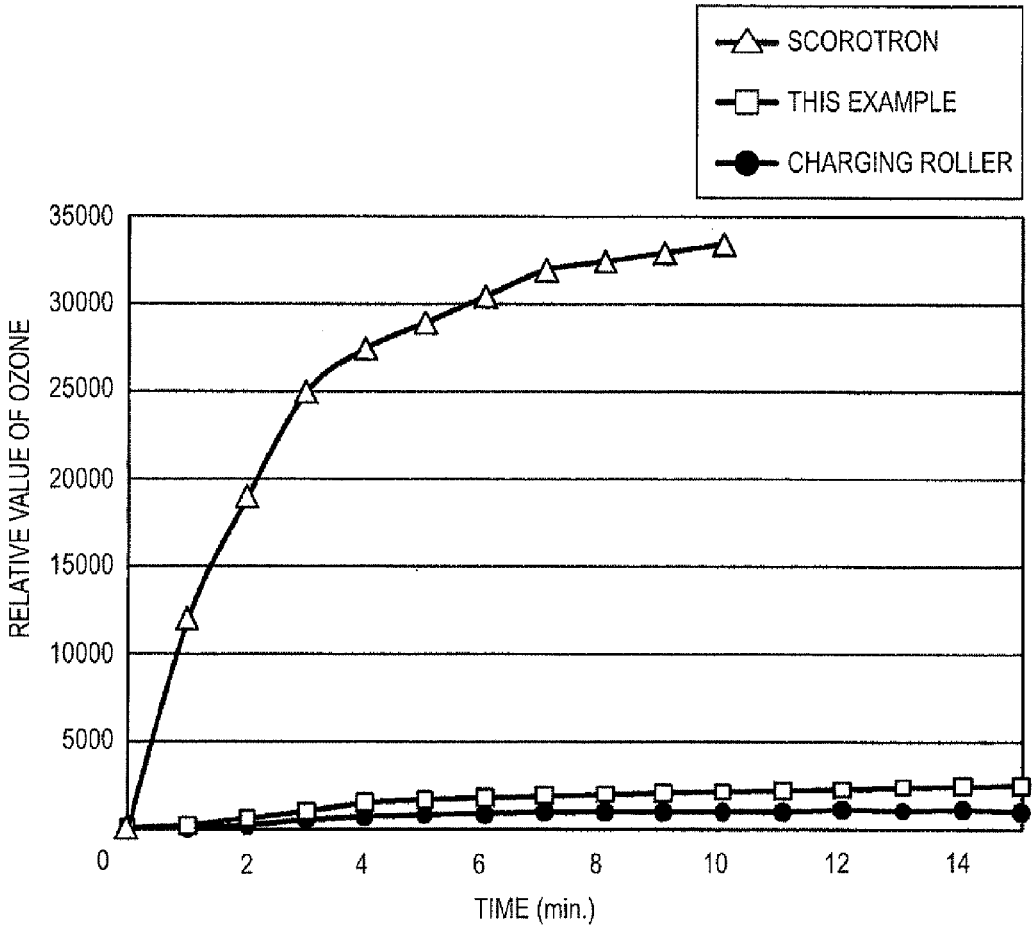
FIG. 7 is a diagram illustrating the comparison results between the amounts of ozone according to an example.

FIG. 7 shows the comparison results between the amounts of ozone generated when the structure according to this example and a scorotron method are used under the above-mentioned charging conditions. The structures according to this example and the scorotron method are both a non-contact charging method.

The comparison results at the time when the amount of ozone detected after 10 minutes of continuous charging was substantially saturated proved that the amount of ozone generated in this example was at least equal to or less than about one-tenth of that in the scorotron method. In the charging method using a scorotron, in general, a unit, such as an ozone filter, is used to limit the amount of ozone.

For reference, FIG. 7 also shows the amount of ozone when a charging roller, which is a contact-type charging unit contacting the image carrier 44, is used.

Figure 8:
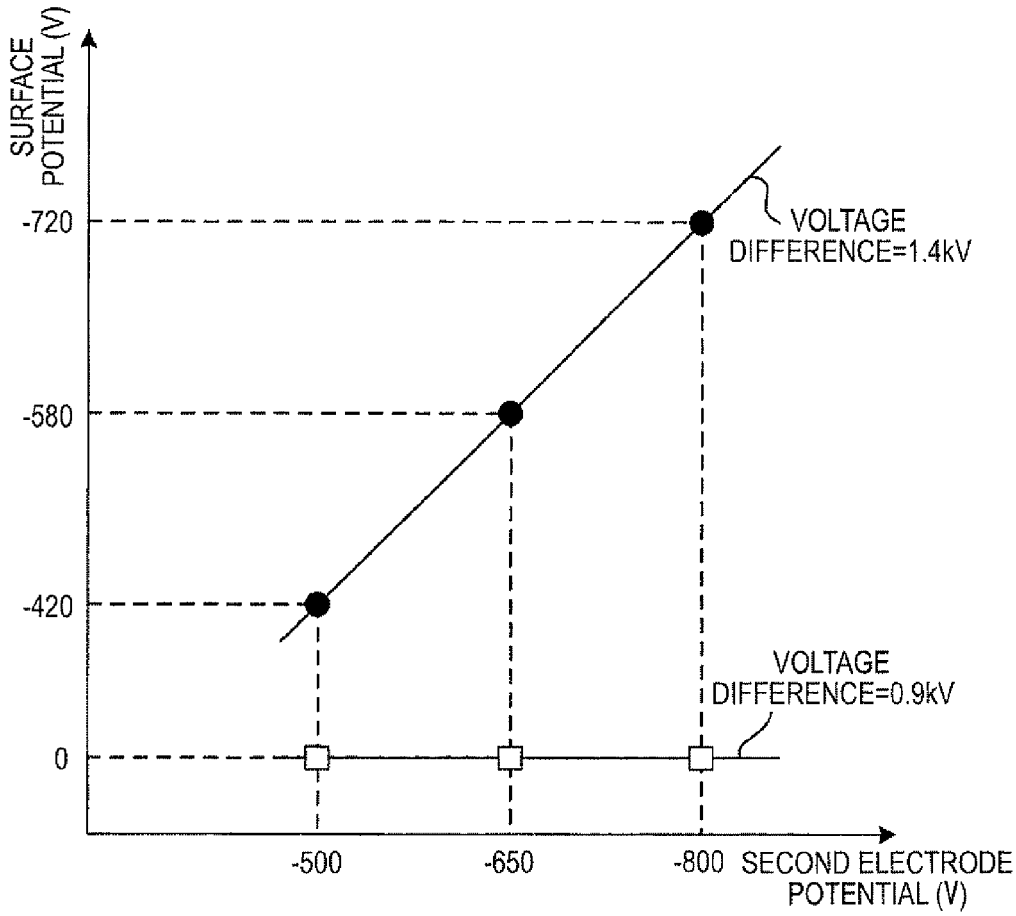
FIG. 8 is a diagram illustrating the measurement result of a surface potential according to an example.

FIG. 8 shows a variation in the average surface potential (charging potential) of the image carrier 44 for one period when the potentials of the resistive layer 74 (first electrode) and the conductive layer 78 (second electrode) are changed in the above-mentioned structure.

Under the conditions that the difference between a voltage applied to the resistive layer 74 (first electrode) and a voltage applied to the conductive layer 78 (second electrode) is maintained at 1.4 kV (example 1: the first electrode=−2.2 kV and the second electrode=−0.8 kV, and example 2: the first electrode=−1.9 kV and the second electrode=−0.5 kV), that is, when a sufficient discharge occurs between both electrodes, the voltage applied to the conductive layer 78 (second electrode) is equal to the charging potential of the image carrier 44. Therefore, the charged particles generated between the electrodes are moved by the electric field between the conductive layer 78 (second electrode) and the image carrier 44 and the image carrier 44 is charged.

In contrast, under the conditions that the difference between a voltage applied to the resistive layer 74 (first electrode) and a voltage applied to the conductive layer 78 (second electrode) is maintained at 0.9 kV (example 1: the first electrode=−1.7 kV and the second electrode=−0.8 kV, and example 2: the first electrode=−1.4 kV and the second electrode=−0.5 kV), that is, when a discharge rarely occurs between both electrodes, charged particles required to charge the image carrier 44 are not generated and the image carrier 44 is not charged.

As such, when sufficient charged particles to charge the image carrier 44 are generated by the discharge between both electrodes, that is, the resistive layer 74 (first electrode) and the conductive layer 78 (second electrode), the potential of the image carrier 44 is controlled by controlling a voltage applied to the conductive layer 78 (second electrode).

Figure 9:
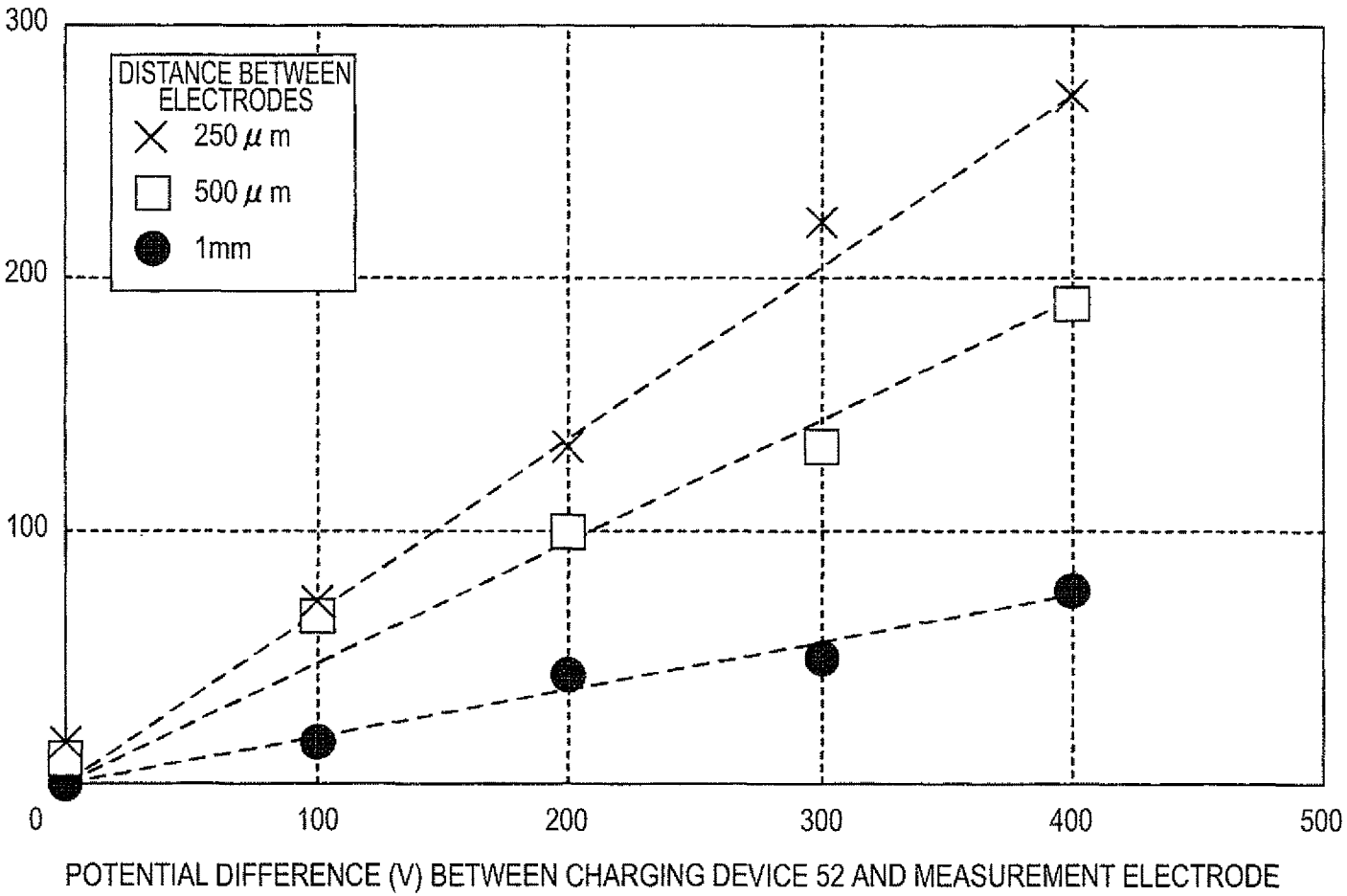
FIG. 9 is a diagram illustrating the measurement result of a current flowing at the position of an image carrier.

FIG. 9 shows the measurement result of a current flowing through a measurement electrode when the measurement electrode with a size of Φ1 mm is arranged at the position of the image carrier 44 and there is a potential difference between the charging device 52 and the measurement electrode.

As shown in FIG. 9, a current that is proportional to the distance (inter-electrode distance) and potential difference between the charging device 52 and the measurement electrode is detected. As such, the charged particles generated by the charging device 52 are drifted by the potential difference and are observed by the measurement electrode.

Therefore, no discharge occurs between the image carrier 44 and the charging device 52. That is, the image carrier 44 serves as an electrode and no discharge occurs.

Figure 10:
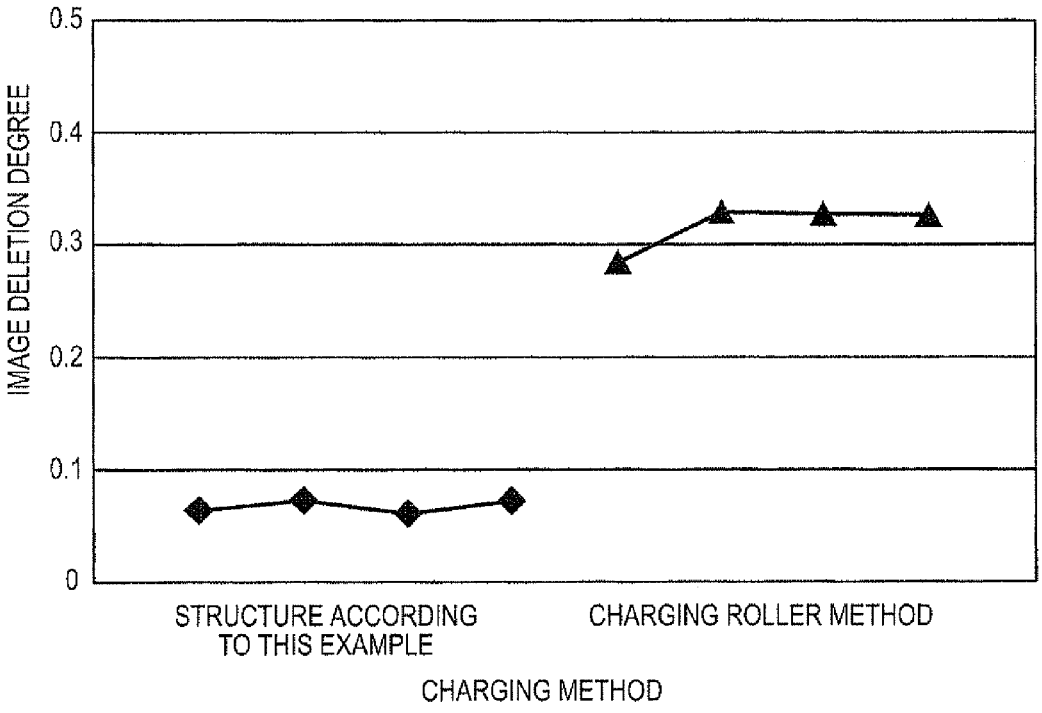
FIG. 10 is a diagram illustrating the result of a charge stress test according to an example.

For reference, FIG. 10 shows the generation rate of the image deletion of a sample when the charge stress test that repeatedly charges and neutralizes each image carrier using the structure according to this example and the charging roller method is performed and the sample is printed by an image forming apparatus using each image carrier subjected to the charge stress test under the conditions of a temperature of 28° C. and a humidity of 80%. As can be seen from the result shown in FIG. 10, the generation rate of the image deletion of the image carrier subjected to the charge test in the structure according to this example is significantly lower than that in the charging roller method. However, the conditions of the charge stress test are as follows:

Charging potential: −700 V;

Process speed: 120 mm/sec; and

Period for which voltage is applied: 500 rotations.

In addition, a voltage in which a DC component was superposed on the following AC component was applied to the charging roller:

Frequency: 950 Hz;

DC voltage: −720 V; and

AC voltage (voltage between peaks): 1850V, which is 1.25 times more than an AC voltage where a charging potential is saturated.

The image carrier used in the charge stress test is an organic photoconductor obtained by sequentially laminating an underlayer, a photosensitive layer, and a charge transport layer on an aluminum cylinder connected to the ground. The underlayer has a thickness of 15 μm and functions to maintain charging characteristics. The photosensitive layer has a thickness of 1 μm or less and functions to receive light with a wavelength of about 800 nm and generate charge. The charge transport layer has a thickness of 29 μm and functions to transport the charge (hole) generated in the photosensitive layer to the surface of a photoconductor.

An experimental device for the charge stress test has only a function of rotating the image carrier, a charging function (this example or the charging roller method), and a neutralization function (neutralization lamp), but does not have a cleaning blade. The degree of image deletion is checked by the image forming apparatus using the image carrier subjected to the charge stress test. In this way, the influence of the charge stress applied to the image carrier by the charging unit is accelerated and checked.

An example in which the charging device according to the exemplary embodiment of the invention is applied to the image forming apparatus has been described above, but the application of the charging device according to the exemplary embodiment of the invention is not limited thereto. For example, the charging device according to the exemplary embodiment of the invention can be applied for the following purposes:

A neutralization process for applying charge with a polarity opposite to that of the charge to neutralize the charge such that an electrostatic discharge does not occur due to charging by a device in a process of manufacturing an electronic device;

A process of modifying the surface of a solid-state material (for example, a hydrophilic process or a hydrophobic process); and A disinfection and sterilization process in the food processing or medical field.

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. A charging device comprising:

a first electrode;

a second electrode;

an insulating body that is provided between the first electrode and the second electrode;

wherein either the first electrode or the second electrode includes an opening portion that is formed so as to open toward a first direction in which the first electrode, the insulating body, and the second electrode are laminated, the insulating body includes a region limiting portion which is a space that is in contact with the opening portion, and opens toward a direction in which the region limiting portion communicates with the opening portion, and is limited in a second direction vertical to the first direction; and wherein a glow discharge occurs in the region limiting portion when a voltage is applied between the first electrode and the second electrode.

2. The charging device according to claim 1, wherein a space including the opening portion and the region limiting portion is adjacent to the first electrode and the second electrode.

3. The charging device according to claim 1, wherein at least one of the first electrode and the second electrode has a volume resistivity equal to or more than about $1\times10^{6}$ Ωcm and equal to or less than about $1\times10^{10}$ Ωcm.

4. The charging device according to claim 1, wherein the region limiting portion has a length equal to or more than about 4 μm and equal to or less than about 200 μm.

5. The charging device according to claim 1, wherein the length of the region limiting portion in the second direction is equal to or more than about 4 μm and equal to or less than about 200 μm.

6. The charging device according to claim 1, wherein a space including the opening portion and the region limiting portion has a cylindrical shape.

7. The charging device according to claim 1, wherein a plurality of spaces each including the opening portion and the region limiting portion are provided in the insulating body.

8. A cartridge for an image forming apparatus, comprising:

an image carrier;

a charging device that is arranged so as not to contact the image carrier and charges the image carrier, the charging device including a first electrode, a second electrode, an insulating body that is provided between the first electrode and the second electrode; wherein either the first electrode or the second electrode includes an opening portion that is formed so as to open toward a first direction in which the first electrode, the insulating body, and the second electrode are laminated, and the insulating body includes a region limiting portion which is a space that is in contact with the opening portion, and opens toward a direction in which the region limiting portion communicates with the opening portion, and is limited in a second direction vertical to the first direction;

a developing device that develops a latent image, which is formed on the image carrier charged by the charging device by exposure, with a developer; and wherein a glow discharge occurs in the region limiting portion when a voltage is applied between the first electrode and the second electrode.

9. An image forming apparatus comprising:

an image carrier;

a charging device that is arranged so as not to contact the image carrier and charges the image carrier, the charging device including a first electrode, a second electrode, an insulating body that is provided between the first electrode and the second electrode; wherein either the first electrode or the second electrode includes an opening portion that is formed so as to open toward a first direction in which the first electrode, the insulating body, and the second electrode are laminated, and the insulating body includes a region limiting portion which is a space that is in contact with the opening portion, and opens toward a direction in which the region limiting portion communicates with the opening portion, and is limited in a second direction vertical to the first direction;

a developing device that develops a latent image, which is formed on the image carrier charged by the charging device by exposure, with a developer;

a transfer unit that transfers an image developed by the developing device onto a recording medium;

a fixing unit that fixes the image transferred to the recording medium by the transfer unit to the recording medium; and wherein a glow discharge occurs in the region limiting portion when a voltage is applied between the first electrode and the second electrode.

10. The charging device according to claim 1, wherein the opening portion penetrates the first electrode or the second electrode towards the first direction.

11. The charging device according to claim 1, wherein the region limiting portion limits a discharge region in the second direction vertical to the first direction.

12. The cartridge according to claim 8, wherein the opening portion penetrates the first electrode or the second electrode towards the first direction.

13. The cartridge according to claim 8, wherein the region limiting portion limits a discharge region in the second direction vertical to the first direction.

14. The image forming apparatus according to claim 9, wherein the opening portion penetrates the first electrode or the second electrode towards the first direction.

15. The image forming apparatus according to claim 9, wherein the region limiting portion limits a discharge region in the second direction vertical to the first direction.

* * * * *